US005299735A

United States Patent [19]

Thomas

[11] Patent Number: 5,299,735

[45] Date of Patent: Apr. 5, 1994

[54] TRACK-BED SYSTEM FOR MODEL RAILROAD

[76] Inventor: Herbert Y. Thomas, 110 S. 7th St., North Wales, Pa. 19454

[21] Appl. No.: 66,502

[22] Filed: May 24, 1993

[51] Int. Cl.[5] ..... E01B 23/00

[52] U.S. Cl. ..... 238/10 B; 238/10 E; 238/382

[58] Field of Search ..... 104/DIG. 1; 238/10 A, 238/10 B, 10 C, 10 E, 10 F, 151, 382

[56] References Cited

U.S. PATENT DOCUMENTS

| | | | |
|---|---|---|---|
| 2,665,848 | 1/1954 | Smith et al. | 238/10 E X |
| 4,953,786 | 9/1990 | Arsenault | 238/10 F X |
| 4,955,537 | 9/1990 | Bratovz | 238/10 E X |

FOREIGN PATENT DOCUMENTS

| | | | |
|---|---|---|---|
| 658482 | 10/1951 | United Kingdom | 238/10 E |

*Primary Examiner*—Robert J. Oberleitner
*Assistant Examiner*—S. Joseph Morano
*Attorney, Agent, or Firm*—Michael F. Petock

[57] ABSTRACT

The present invention shows a system for providing a track-bed with a real-life appearance in a model railroad. The system is comprised of three separate components which may be assembled in combination to meet the needs of various track formations. A first component is intended to fit between the track bases of a model railroad track, and both curved and straight variations of the first component are provided. A second component is intended to fit between the track bases of adjoining sections of track, and both curved and straight-sided variations of the second component may be provided, or a single version which may be trimmed to fit either a straight or curved application might be provided. The third component is triangular in cross-section and closes the open sides of the first and second components at the side of the track. The third component is preferably flexible in nature and may be provided in any suitable length. The straight variation of the first component and both straight and curved variations of the second component may be provided in any suitable length, and may be trimmed to fit any track layout situation.

25 Claims, 2 Drawing Sheets

FIG. 1
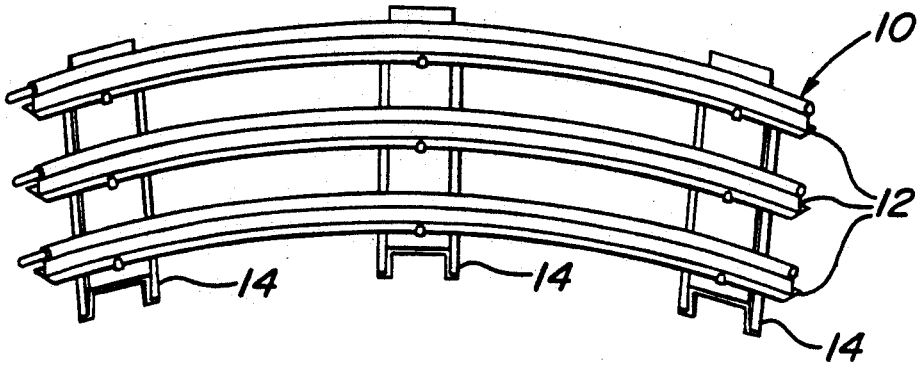
FIG. 2
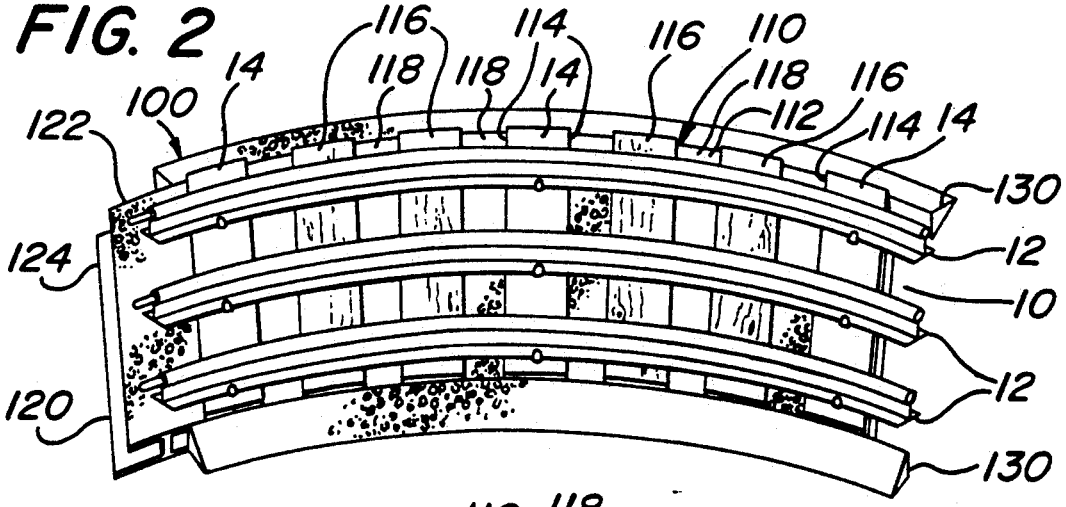
FIG. 4
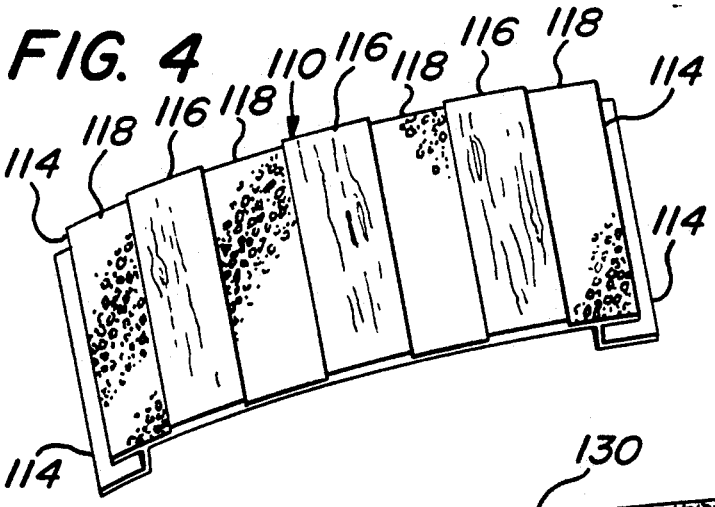
FIG. 5
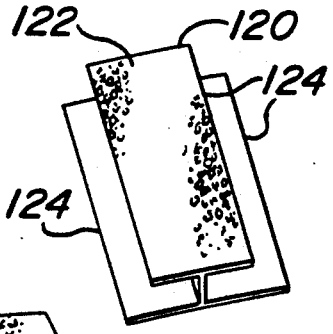
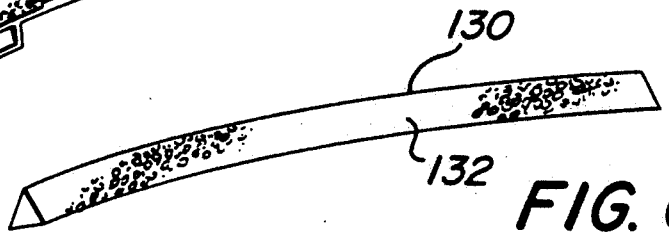
FIG. 6

TRACK-BED SYSTEM FOR MODEL RAILROAD

BACKGROUND OF THE INVENTION

1. Field of the Invention

The present invention relates to a system for providing a track-bed with a real-life appearance in a model railroad. In particular, the present invention relates to a system for providing a track-bed for a model railroad track having a plurality of spaced-apart electrified track rails separated by a plurality of track bases capable of holding said rails raised above a platform surface, and supporting said track rails and any model railroad equipment using said track, said track-bed having a real-life appearance, said system comprising:

a first component having a top surface adapted to provide the appearance of a real-life railroad track bed, said first component having a width at least equal to the largest width of said railroad track, a height slightly less than the distance which the track base raises the track rails, and a length approximately equal to the spacing between the track bases;

a second component having a top surface adapted to provide the appearance of a real-life railroad track bed, said second component having a width at least equal to the largest width of said railroad track, a height slightly less than the distance which the track base raises the track rails, and a length approximately equal to the spacing between two joined track sections; and, a third component of indeterminate length and comprising a regular right triangle in cross-section with two sides approximately equal to the height of the first and second components, and the surface of the hypotenuse being adapted to provide the appearance of a real-life track bed, and wherein a section of model railroad track may be adapted to appear life-like by providing at least one first component between the track bases of each section of track, providing a second component between the track bases of each joined section of track, and providing a portion of said third component along the sides of said track section.

2. Description of Related Art

For many years, hobby enthusiasts have enjoyed the operation of model railroad trains, and have lately labored to create life-like settings in which to operate the model trains. Such enthusiasts have been known to go to great lengths to simulate the realism of an actual railroad lay-out, including scale models of buildings, cars and people, which are intricately prepared, painted, and positioned, to create the life-like setting.

One difficulty often encountered in creating such a life-like scene, however, is the original track upon which the model railroad trains run. Because the model versions are electrically powered by an external source of electricity, rather than internally powered by steam or diesel, as their full-size brethren, the tracks must be constructed to carry electrical energy to the model trains. Such original track bears little resemblance to the actual full-scale railroad track bed and when originally designed, the "scale appearance" had no bearing or consequence.

Hobbyists and model makers have created a life-like track, but every scale hobby design requires the painstaking creation of a track and bed which, therefore, is rarely changed. Those who create a layout for seasonal or special occasions do not have the time to create such a track bed and this causes the quality of the presentation to suffer. Also, the ability to break down or change the layout as new trackage is needed normally creates a metal track to wood contact which, because of the model trains weight, can cause a noisy situation.

Alternatively, there has been marketed a rubberized plastic casting into which the model railroad track section can be placed, and these castings can be cast with a life-like design on the surface of the rubberized material to simulate an actual track bed. The difficulty with these castings, however, is that they are not versatile for various scenic applications and can be used only for single track applications without destruction. In addition, because of the need to surround the base portions of the track sections, the castings must be formed of a rubberized material, which is expensive, and has a color and shape which are difficult to alter without destruction.

SUMMARY OF THE INVENTION

It is an object of the present invention to provide a system for providing a track bed for a seasonal model railroad with a real-life appearance.

It is another object of the present invention to provide a system for providing a life-like appearing track bed for a model railroad which is inexpensive, and which can easily be adapted to alternate track lay outs.

It is a further object of the present invention to provide a base for a "permanent scale" model railroad with a real-life appearance which can be enhanced by the addition of other commercially available products.

The other objects, features and advantages of the present invention will become more apparent in light of the following detailed description of the preferred embodiment thereof.

According to a preferred embodiment of the present invention, there is provided a system for providing a track-bed for a model railroad track having a plurality of spaced-apart electrified track rails separated by a plurality of track bases capable of holding said rails raised above a platform surface, and supporting said track rails and any model railroad equipment using said track, said track-bed having a real-life appearance, said system comprising:

a first component having a top surface adapted to provide the appearance of a real-life railroad track bed, said first component having a width at least equal to the largest width of said railroad track, a height slightly less than the distance which the track base raises the track rails, and a length approximately equal to the spacing between the track bases;

a second component having a top surface adapted to provide the appearance of a real-life railroad track bed, said second component having a width at least equal to the largest width of said railroad track, a height slightly less than the distance which the track base raises the track rails, and a length approximately equal to the spacing between two joined track sections; and, a third component of indeterminate length and comprising a regular right triangle in cross-section with two sides approximately equal to the height of the first and second components, and the surface of the hypotenuse being adapted to provide the appearance of a real-life track bed, and wherein a section of model railroad track may be adapted to appear life-like by providing at least one first component between the track bases of each section of track, providing a second component between the track bases of each joined section of track, and providing a portion of said third component along the sides of said track section.

According to another embodiment of the present invention, there is provided a system for providing a track-bed for a model railroad track having a plurality of spaced-apart electrified track rails separated by a plurality of track bases capable of holding said rails raised above a platform surface, and supporting said track rails and any model railroad equipment using said track, said track-bed having a real-life appearance, said system comprising:

a first component having a top surface adapted to provide the appearance of a real-life railroad track bed of ballast and equally spaced railroad ties, said first component having a width at least equal to the largest width of said railroad track base, a height of two elevations, the first being the distance which the track base raises the track rails, said first elevation adapted to have the appearance of real life rail road track ties, and a lower elevation intermediate between the height of said first elevation and the track base, said second height adapted to have the appearance of real life railroad track ballast, and a length approximately equal to the spacing between the track bases;

a second component having a top surface adapted to provide the appearance of a real-life railroad track bed ballast, said second component having a width at least equal to the largest width of said railroad track base, a height less than the distance which the track base raises the track rails but equal to the second elevation of the first component, and a length approximately equal to the spacing between two joined track sections; and, a third component of indeterminate length and comprising a regular right triangle in cross-section with two sides equal to the height of the lower elevation of the first component and the height of the second component, and the surface of the hypotenuse being adapted to provide the appearance of a real-life track bed ballast slopped for drainage, wherein said first and second components are further provided with tabs upon which the model railroad track base rests, to provide a sound dampener between the track base and the platform surface, and wherein a section of model railroad track may be adapted to appear life-like by providing at least one first component between the track bases of each section of track, providing a second component between the track bases of each joined section of track, and providing a portion of said third component along the sides of said track section as required by a layouts scenic requirements.

According to still another embodiment of the present invention, there is provided a system for providing a track-bed for a model railroad track having a plurality of spaced-apart electrified track rails separated by a plurality of track bases capable of holding said rails raised above a platform surface, and supporting said track rails and any model railroad equipment using said track, said track-bed having a real-life appearance, said system comprising:

a first component having a top surface adapted to provide the appearance of a real-life railroad track bed of ballast and equally spaced railroad ties, said first component having a width at least equal to the largest width of said railroad track base, a height of two elevations, the first being the distance which the track base raises the track rails said first elevation adapted to have the appearance of real life rail road track ties, and a lower elevation intermediate between the height of said first elevation and the track base, said second height adapted to have the appearance of real life railroad track ballast, and a length approximately equal to the spacing between the track bases;

a second component having a top surface adapted to provide the appearance of a real-life railroad track bed ballast, said second component having a width at least equal to the largest width of said railroad track base, a height less than the distance which the track base raises the track rails but equal to the second elevation of the first component, and a length approximately equal to the spacing between two joined track sections; and, wherein said first and second components are further provided with tabs upon which the model railroad track base rests, to provide a sound dampener between the track base and the platform surface, and wherein a section of model railroad track may be adapted to appear life-like by providing at least one first component between the track bases of each section of track, and providing a second component between the track bases of each joined section of track, and wherein sections of said railroad track so provided are positioned in a side-by-side lay-out to simulate a rail yard arrangement.

BRIEF DESCRIPTION OF THE DRAWINGS

FIG. 1 shows a section of model railroad track with which the system of the present invention is intended to be used.

FIG. 2 shows the components of the track bed system of the present invention as assembled with a track section of model railroad track in the single track mode.

FIG. 4 shows one component of another embodiment of the track bed system of the present invention.

FIG. 5 shows a second component of the track bed system of the present invention.

FIG. 6 shows a third component of the track bed system of the present invention.

DETAILED DESCRIPTION OF THE PREFERRED EMBODIMENT

Figure 3:
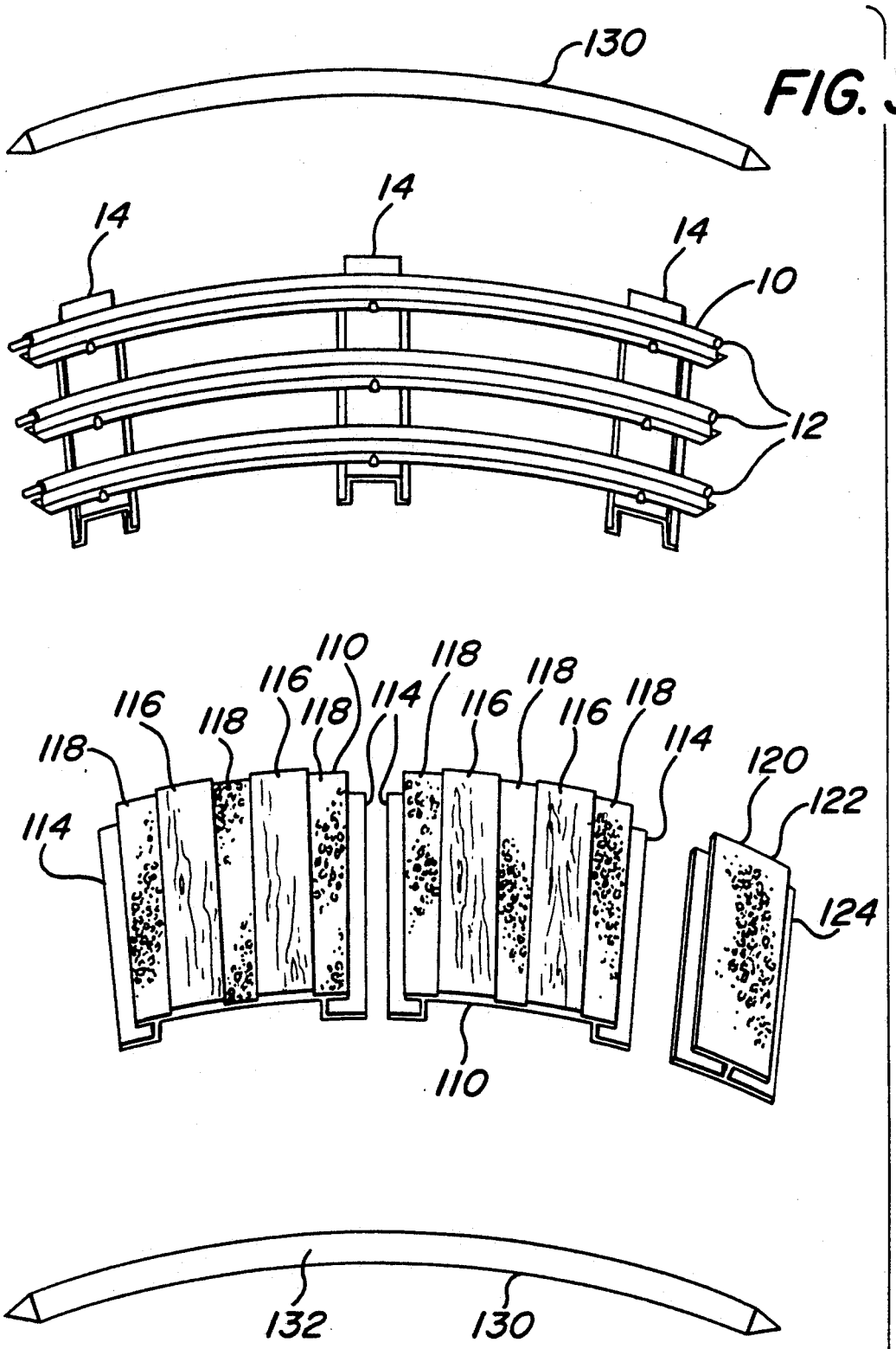
FIG. 3 shows an exploded view of the components of the track bed system of the present invention as assembled with a track section of model railroad track in the single track mode.

The present invention is a system for providing a model railroad track section with a real-life appearance in a model railroad and as a base for further scenic enhancement. The system is comprised of three separate component types which may be assembled in various combinations to meet the needs of various track formations. A first component is intended to fit between the track bases of a model railroad track, and both curved and straight variations of the first component are provided. A second component is intended to fit between the track bases of adjoining sections of track, and both curved and straight-sided variations of the second component may be provided, or a single version which may be trimmed to fit either a straight, or curved, straight-to-curved, or reversed-curve application might be provided. The third component is triangular in cross-section and closes the open lateral sides of the first and second components at the side of the track. The third component is preferably flexible in nature and may be provided in any suitable length.

In particular, the present invention comprises a system for providing a track-bed for a model railroad track. FIG. 1 shows the model railroad track 10 with which the present invention is employed. This track 10 is shown having a plurality of spaced-apart electrified track rails 12 separated by a plurality of track bases 14 capable of holding the rails 12 parallel and raised above a platform support surface. The track bases 14 also support the track rails 12 and any model railroad equipment using said track.

FIG. 2 shows the components of the track bed system of the present invention as assembled with a track section of model railroad track. The track-bed system 100 of the present invention is provided with a real-life appearance. Further, the track bed system 100 comprises a first component 110 having a top surface 112 adapted to provide the appearance of a real-life railroad track. This top surface 112 is further comprised of portions of a higher top surface 116 adapted to provide the appearance of additional track bases to represent the spacing of railroad ties, and portions of a lower top surface 118 adapted to provide the appearance of ballast, or to provide a surface to which the hobbyist can add ballast, and a tab 114 on which the track base 14 of the railroad track 10 rests for sound dampening. This first component 110 has a width at least equal to the largest width of said railroad track, usually the length of the track bases 14, a height (not including the tab 114) equal to the distance which the track bases 14 raise the track rails 12, and a length approximately equal to the spacing between the track bases 14.

In addition, the track bed system of the present system further comprises a second component 120 having a top surface 122 adapted to provide the appearance of a real-life railroad track ballast, and a tab 124 on which the track base 14 of the railroad track 10 rests for sound dampening. This second component has a width at least equal to the largest width of said railroad track, a height equal to the elevation of top surface 112 of the first component, and a length approximately equal to the spacing between two joined track sections.

Finally, the track bed system of an embodiment of the present invention further comprises a third component 130 of indeterminate length and comprising a regular right triangle in cross-section with two sides equal to the height of the lower level of the first component and the height of the second component, including tabs, and the surface 132 of the side of the hypotenuse being adapted to provide the appearance of a real-life track bed.

In this manner, a section of model railroad track, such as that shown in FIG. 1, may be adapted to appear life-like, such as that shown in FIG. 2. This is done, as illustrated in FIG. 3, by providing at least one first component 110 between the track bases 14 of the section of track 10, providing a second component 120 between the track bases 14 where sections of track 10 are joined, and providing a portion of said third component 130 along the lateral sides of the track section 10.

The remaining Figures show the components of the present invention in greater detail. FIG. 4 shows the first component 110 of the track bed system of the present invention provided with different numbers of higher portions 116 and lower portions 118, namely: three higher portions 116 and four lower portions 118. As previously noted, this first component 110 has a width at least equal to the largest width of said railroad track, usually the width of the track bases 14, a height, not including the tab 114, equal to the distance which the track bases 14 raise the track rails 12, and a length equal to the spacing between the track bases 14.

Further, the first component 110 is adapted on its top surface 112, including the higher portions 116 and the lower portions 118, With suitable decorative elements to provide the appearance of a real-life railroad track bed. These decorative elements may include railroad ties, railroad spikes, stone or gravel ballast, sand, or other elements expected to be found on a real railroad track. Further, the first component 110 is provided with adaptive means 114 at each end thereof for the track base of a section of track to rest for sound dampening.

The first component 110 is intended to be employed with both curved and straight track sections, and both curved and straight variations are envisioned. Because the first component 110 is intended for use in a stable position where the model railroad track base spacing is constant, this component may be constructed from a material with limited flexibility. Any thermoformed plastic would probably be suitable, if it can be provided with suitable decorative effects, although best application results would be expected if all components were prepared from the same material.

FIG. 5 shows a second component of the track bed system of the present invention. As previously noted, the track bed system of the present system further comprises a second component 120 having a top surface 122 adapted to provide the appearance of a real-life railroad track bed. This second component has a width at least equal to the largest width of said railroad track, a height equal to the lower elevation 118 of the top surface 112 of the first component 110, and a length approximately equal to the spacing between two joined track sections.

Further, the second component 120 is adapted on its top surface 122 with suitable decorative elements to provide the appearance of a real-life railroad track ballast. Further, the second component 120 is provided with adaptive means 124 at each end for the track base of each of the joined sections of track to rest for sound dampening.

The second component 120 is intended to be employed in joining curved-to-curved and straight-to-straight track sections, and in joining both straight-to-curved transitions as well as reversed curved transitions. For this reason, both curved and straight sections as well as the sections permitting the various transitions are envisioned. Alternatively, a single universal design can be employed which has the ability to be easily modified, by cutting or the like, to fit the requirements of each installation. Because the second component 120 is intended for use in a stable position where the dimensions may not be constant, this component may be constructed from a material with limited flexibility, but easily modified. Any thermoformed plastic would probably be suitable, if it can be provided with suitable decorative effects, although best application results would be expected if all components were prepared from the same material.

FIG. 6 shows a third component of the track bed system of the present invention. As previously noted, the track bed system of the present invention further comprises a third component 130 of indeterminate length and comprising a regular right triangle in cross-section with two sides approximately equal to the height, not including tabs, of the lower elevation 118 of the top surface 112 of the first component 110 and the second component 120.

Further, the third component 130 is adapted on the surface 132 of the side of the triangle's hypotenuse to provide the appearance of real-life track ballast. Further, the third component 130 is adapted to engage the lateral sides of the assembled first and second components to complete the track bed system. This engagement can be through the use of a mastic, or snap-together tabs, or any other method known to the art.

The third component 130 is intended to be employed to close the lateral sides of the assembled first and second components. For this reason, both curved and straight sections as well as the sections permitting the various transitions are envisioned, so the third component may be formed from a sufficiently flexible material to accommodate use in both curved, straight and transitional sections. Any thermoformed plastic would probably be suitable, if it can be provided with suitable decorative effects, although best application results would be expected if all components were prepared from the same material.

It should be noted that layouts are envisioned without the need for the third component. This might occur in a "yard" type layout, where two or more lines of track are placed side by side. In such a layout, the hobbyist might fill the space between the track sections with additional ballast to create a continuous grade. At the same time, portions of the third component might be used at the lateral edges of the multiple track layout.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. A system for providing a track-bed for a model railroad track having a plurality of spaced-apart electrified track rails separated by a plurality of track bases capable of holding said rails raised above a platform surface, and supporting said track rails and any model railroad equipment using said track, said track-bed having a real-life appearance, said system comprising:

a first component having a top surface adapted to provide the appearance of a real-life railroad track bed, said first component having a width at least equal to the largest width of said railroad track, a height slightly less than the distance which the track base raises the track rails, and a length approximately equal to the spacing between the track bases;

a second component having a top surface adapted to provide the appearance of a real-life railroad track bed, said second component having a width at least equal to the largest width of said railroad track, a height slightly less than the distance which the track base raises the track rails, and a length approximately equal to the spacing between two joined track sections; and, a third component of preselected length and comprising a regular right triangle in cross-section with two sides approximately equal to the height of the first and second components, and the surface of the hypotenuse being adapted to provide the appearance of a real-life track bed, and wherein a section of model railroad track may be adapted to appear life-like by providing at least one said first component between the track bases of each section of track, providing a said second component between the track bases of each joined section of track, and providing a portion of said third component along the sides of said track section.

2. The track bed system of claim 1 in which the first component is adapted to fit between the track bases of a straight track section of model railroad track.

3. The track bed system of claim 1 in which the first component is adapted to fit between the track bases of a curved track section of model railroad track.

4. The track bed system of claim 1 in which the second component is adapted to fit within the junction of two straight sections of model railroad track.

5. The track bed system of claim 1 in which the second component is adapted to fit within the junction of curved to curved sections of model railroad track.

6. The track bed system of claim 1 in which the second component is adapted to fit within the junction of two reversed curved sections of model railroad track.

7. The track bed system of claim 1 in which the second component is adapted to fit within the junction of a straight-to-curved transition of model railroad track.

8. The track bed system of claim 1 in which the second component is adaptable to fit different model track transitions.

9. The track bed system of claim 1 in which the third component is adapted to enclose the lateral sides of a combination of first and second components along a straight track section.

10. The track bed system of claim 1 in which the third component is adapted to enclose the lateral sides of a combination of first and second components along a curved track section.

11. The track bed system of claim 1 in which the third component is adapted to enclose the lateral sides of a combination-of first and second components in different track combinations.

12. A system for providing a track-bed for a model railroad track having a plurality of spaced-apart electrified track rails separated by a plurality of track bases capable of holding said rails raised above a platform surface, and supporting said track rails and any model railroad equipment using said track, said track-bed having a real-life appearance, said system comprising:

a first component having a top surface adapted to provide the appearance of a real-life railroad track bed of ballast and equally spaced railroad ties, said first component having a width at least equal to the largest width of said railroad track base, a height of two elevations, the first being the distance which the track base raises the track rails, said first elevation adapted to have the appearance of real life rail road track ties, and a second lower elevation intermediate between the height of said first elevation and the track base, said second height adapted to have the appearance of real life railroad track ballast, and a length approximately equal to the spacing between the track bases;

a second component having a top surface adapted to provide the appearance of real-life railroad track bed ballast, said second component having a width at least equal to the largest width of said railroad track base, a height less than the distance which the track base raises the track rails but equal to the second elevation of the first component, and a length approximately equal to the spacing between two joined track sections; and, a third component of preselected length and comprising regular right triangle in cross-section with two sides equal to the height of the lower elevation of the first component and the height of the second component, and the surface of the hypotenuse being adapted to provide the appearance of a real-life track bed ballast sloped to provide the appearance of real-life track ballast, wherein said first and second components are further provided with tabs upon which the model railroad track base rests, to provide a sound dampener between the track base and the platform surface, and wherein a section of model railroad track is adaptable to appear life-like by providing at least one said first component between the track bases of each section of track, providing a said second component between the track bases of each joined section of track, and providing a portion of said third component along the sides of said track section as required by a layout's scenic requirements.

13. The track bed system of claim 12 in which the first component is adapted to fit between the track bases of a straight track section of model railroad track.

14. The track bed system of claim 12 in which the first component is adapted to fit between the track bases of a curved track section of model railroad track.

15. The track bed system of claim 12 in which the second component is adapted to fit within the junction of two straight sections of model railroad track.

16. The track bed system of claim 12 in which the second component is adapted to fit within the junction of curved to curved sections of model railroad track.

17. The track bed system of claim 12 in which the second component is adapted to fit within the junction of two reversed curved sections of model railroad track.

18. The track bed system of claim 12 in which the second component is adapted to fit within the junction of a straight-to-curved transition of model railroad track.

19. The track bed system of claim 12 in which the second component may be adapted to fit within the junction of different model track transitions.

20. The track bed system of claim 12 in which the third component is adapted to enclose the lateral sides of a combination of first and second components along a straight track section.

21. The track bed system of claim 12 in which the third component is adapted to enclose the lateral sides of a combination of first and second components along a curved track section.

22. The track bed system of claim 12 in which the third component is adapted to enclose the lateral sides of a combination of first and second components different track combinations.

23. The track bed system of claim 12 in which the second height of said first component acts as a base for the provision of additional scale ballast.

24. A system for providing a track-bed for a model railroad track having a plurality of spaced-apart electrified track rails separated by a plurality of track bases capable of holding said rails raised above a platform surface, and supporting said track rails and any model railroad equipment using said track, said track-bed having a real-life appearance, said system comprising:

a first component having a top surface adapted to provide the appearance of a real-life railroad track bed of ballast and equally spaced railroad ties, said first component having a width at least equal to the largest width of said railroad track base, a height of two elevations, the first being the distance which the track base raises the track rails, said first elevation adapted to have the appearance of real life rail road track ties, and a second lower elevation intermediate between the height of said first elevation and the track base, said second height adapted to have the appearance of real life railroad track ballast, and a length approximately equal to the spacing between the track bases;

a second component having a top surface adapted to provide the appearance of a real-life railroad track bed ballast, said second component having a width at least equal to the largest width of said railroad track base, a height less than the distance which the track base raises the track rails but equal to the second elevation of the first component, and a length approximately equal to the spacing between two joined track sections; and, wherein said first and second components are further provided with tabs upon which the model railroad track base rests, to provide a sound dampener between the track base and the platform surface, and wherein a section of model railroad track is adaptable to appear life-like by providing at least one said first component between the track bases of each section of track, and providing a said second component between the track bases of each joined section of track, and wherein sections of said railroad track so provided are positioned in a side-by-side lay-out to simulate a rail yard arrangement.

25. The track bed system of claim 24 wherein said lay-out is further provided with additional scale ballast material.

* * * * *